US006478996B1

(12) United States Patent
Schulz et al.

(10) Patent No.: US 6,478,996 B1
(45) Date of Patent: Nov. 12, 2002

(54) METHOD AND APPARATUS FOR PRODUCING A HIGHLY ORIENTED YARN

(75) Inventors: Detlev Schulz, Radevormwald (DE); Hansjörg Meise, Köln (DE); Klaus Schäfer, Remscheid (DE)

(73) Assignee: Barmag AG, Remscheid (DE)

( * ) Notice: Subject to any disclaimer, the term of this patent is extended or adjusted under 35 U.S.C. 154(b) by 183 days.

(21) Appl. No.: 09/610,275

(22) Filed: Jul. 6, 2000

Related U.S. Application Data

(63) Continuation of application No. PCT/EP99/08420, filed on Nov. 4, 1999.

(30) Foreign Application Priority Data

Nov. 9, 1998 (DE) ..... 198 51 448

(51) Int. Cl.[7] ..... D01D 5/084; D01D 5/092; D01D 5/16; D02G 3/02

(52) U.S. Cl. ..... 264/103; 28/245; 264/210.8; 264/211.14; 264/211.17; 264/237; 425/72.2; 425/104; 425/377; 425/378.2; 425/379.1; 425/382.2; 424/464

(58) Field of Search ..... 264/103, 210.8, 264/211.14, 211.17, 237; 425/72.2, 104, 377, 378.2, 379.1, 382.2, 464; 28/245

(56) References Cited

U.S. PATENT DOCUMENTS

| | | | |
|---|---|---|---|
| 5,034,182 | A | 7/1991 | Sze et al. |
| 5,141,700 | A | 8/1992 | Sze |
| 5,612,063 | A | 3/1997 | Schilo et al. |
| 5,976,431 | A | 11/1999 | Mears |

FOREIGN PATENT DOCUMENTS

| | | |
|---|---|---|
| EP | 0 244 217 A2 | 11/1987 |
| EP | 0 682 720 B1 | 11/1995 |

*Primary Examiner*—Leo B. Tentoni
(74) *Attorney, Agent, or Firm*—Alston & Bird LLP

(57) ABSTRACT

A method and an apparatus for producing a highly oriented yarn (HOY) wherein the yarn is withdrawn from the nozzle of a spinneret at a withdrawal speed of at least 6,500 m/min. The filaments forming the yarn are drawn during their solidification, so that a highly oriented molecular structure forms in the polymer. To withstand the withdrawal tension generated by the high withdrawal speed without overstressing the filaments, the filaments are assisted in their advance before they solidify such that prior to the solidification a tensile stress relief is effective on the filaments, and that during the solidification a reduced withdrawal tension is effective on the filaments while they are drawn.

25 Claims, 5 Drawing Sheets

METHOD AND APPARATUS FOR PRODUCING A HIGHLY ORIENTED YARN

CROSS REFERENCE TO RELATED APPLICATION

The present application is a continuation of International Application No. PCT/EP99/08420 filed Nov. 4, 1999.

BACKGROUND OF THE INVENTION

The invention relates to a method of producing a highly oriented yarn (HOY) from a thermoplastic material and a spinning apparatus for melt spinning a highly oriented yarn.

In the production of synthetic multifilament yarns from a thermoplastic melt in one process step, one distinguishes basically between partially drawn and fully drawn yarns. The partially drawn yarns, which are also described as preoriented yarns (POY), have a partially oriented molecular structure that requires a subsequent drawing in a second process step. In comparison therewith, fully drawn yarns (FDY) are suited for direct further processing without a subsequent drawing. The FDY yarns are drawn in the spinning process at a high ratio by means of draw systems, so that an aligned molecular structure is achieved in the polymer.

To produce a yarn with a highest possible orientation of the molecules of the polymer, methods are also known wherein the yarn is drawn at a high ratio while firming up directly before the solidification of the polymer. In these yarns, known as highly oriented yarns (HOY), a stress-induced crystallization leads to the orientation of the molecules in the polymer. In comparison with the FDY yarns, the known HOY yarns have a lower elastic limit. Depending on the method of further processing, this can lead, due to the force acting upon these yarns, to a permanent deformation and, thus, to an irregular dyeability. The known HOY yarns are totally unsuitable for methods of further processing, wherein major stress peaks act upon these yarns.

Although it is theoretically possible to increase the elastic limit of HOY yarns by increasing the withdrawal speed, there are physical limits set to this process, since in the melt spinning of HOY yarns, the filaments forming the yarn may have only a limited crystallinity during drawing to ensure a safe withdrawal without damage to the yarn. A too highly precrystallized filament is much too frozen in its structure to withstand, without being overstressed, the forces developing in the yield point.

EP 0 530 652 and U.S. Pat. No. 5,612,063, disclose an apparatus and a method for producing a synthetic yarn, wherein the filaments undergo a delayed cooling before their solidification. This further delays crystallization of the filaments, which leads to an increased elastic limit of the yarns. However, the known apparatus and method have the disadvantage that the length of the delayed cooling can be only very limited, since lacking stabilization of the filaments by the air flow represents within this region an increasing risk that the filaments stick together.

EP 244 217, and U.S. Pat. Nos. 5,141,700 and 5,034,182 propose to remove the filaments after passing through a pressurized cooling shaft from the cooling shaft by means of an air stream. This also achieves a delayed crystallization of the filaments. Likewise in EP 0 682 720, a delayed crystallization of the polymer is realized, in that an accompanying air stream is directed onto the filaments before solidification.

The apparatus and methods known in the state of the art are all aimed at producing a synthetic yarn at highest possible takeup speeds without its physical properties undergoing a substantial change. Thus, in these known methods, the decrease in elongation at higher withdrawal speeds is compensated by the delayed crystallization of the polymer in the spinning line. However, these methods are unsuitable for producing HOY yarns with higher elastic limits and with higher tenacities.

In the production of a highly oriented yarn, there exists the problem that the known yarns have too high elongation values and too low tenacity values. The elongation values of the yarn may be improved by increasing the withdrawal speed. An increase in the withdrawal speed, for example, in the apparatus disclosed in EP 0 530 652 and U.S. Pat. No. 5,612,063, is bound to lead to an increase in the withdrawal tension, which results, however, in that the filaments are overstressed during the drawing due to the low tenacity of the filaments.

It is an object of the invention to provide a method and a spinning apparatus for producing a highly oriented yarn (HOY), which exhibits elongation and tenacity values typical of a fully drawn yarn (FDY), and which can be produced with a high spinning reliability.

SUMMARY OF THE INVENTION

The above and other objects and advantages of the present invention are achieved by the provision of a method and apparatus wherein the melted thermoplastic material is extruded through a nozzle of a spinneret to form a plurality of downwardly advancing filaments, and such that the filaments solidify at a location spaced below the nozzle. The filaments are withdrawn from the nozzle under a withdrawal tension so as to cause the filaments to be drawn while being solidified, with the withdrawal tension being generated by a withdrawal speed of at least about 6500 m/min. In addition, the filaments are assisted in their advance before their solidification such that before their solidification the filaments are relieved from tensile stress and during solidification and drawing a reduced withdrawal tension is effective on the filaments. The filaments are also combined during their advance after their solidification, to form an advancing multifilament yarn, which is then wound into a package.

The invention is based on the recognition that overstressing of the filaments can occur in the process of the yarn formation. In high speed spinning, one observes no uniform rise of the yarn speed between the yarn exit from the spinneret and the solidification point of the filaments. After the filaments emerge from the spinneret, a relatively slow acceleration sets in initially, until the start of the stress-induced crystallization. Within few centimeters, the stress-induced crystallization leads to an acceleration of the filaments to the withdrawal speed. In this instance, the tenacity of the filaments must be greater than the forces necessary for the acceleration of the yarn, to avoid filament breakage. In accordance with the invention, the filaments are assisted in their advance before they solidify such that no significant additional tensile stresses resulting from frictional forces of the air act upon the filaments before they solidify. Thus, the filaments are relieved before their solidification, so that a reduced withdrawal tension is effective on the filaments while being drawn during their solidification. With that, one realizes on the one hand a high orientation of the molecules during drawing. On the other hand, a high withdrawal speed is made possible with a correspondingly high withdrawal tension. In this process, the withdrawal tension is generated by a withdrawal speed of at least 6,500 m/min. It has shown that it is thus possible to produce a highly oriented yarn with tenacity values greater than 4cN/dtex and an elongation in the range of 30%.

To assist the movement of the filaments before their solidification or to bring about a relief of the forces engaging on the filaments before their solidification, it is possible to apply basically two variants of the method according to the invention. In a first variant, the speed of the advancing yarns is increased before drawing by a higher injection speed in the extrusion of the filaments. In practice, this possibility can be used only to a certain extent due to the high pressure drops upstream of the spinneret.

In the second variant of the method, the air friction acting upon the filaments is influenced. To this end, the filaments advance after their extrusion through a cooling medium. Directly before the solidification of the filaments, a cooling medium stream is generated that assists the movement of the filaments. This measure effects a reduction of the air friction that exerts a braking effect on the filaments. The cooling medium in use is preferably air.

In a particularly advantageous embodiment of the method, the cooling medium stream has a flow velocity that is substantially the same as the speed of the advancing filaments before their solidification. Thus, no braking flow forces are operative on the filaments, so that the advancing speed of the filaments further increases.

For a further reduction of the tensile forces that are operative during the solidification, it is possible to generate the cooling medium stream with a flow velocity that is greater than the speed of the advancing filaments before they solidify. This permits production of highly oriented yarns of a great tenacity at even higher process speeds.

In a preferred embodiment of the method, for purposes of generating the cooling medium stream, the filaments advance through a constrictor and a diffuser. This allows to generate the cooling medium stream purposefully at one point over a very short distance of the spinning line. Preferably, the narrowest cross section of the constrictor is placed in the spinning line such that it is shortly before the solidification point of the filaments. This measure permits reducing a stress-induced preorientation within the filaments. The yarn firms up within a very short distance, which leads to a particularly high orientation of the molecule chains in the polymer.

In a particularly advantageous further development of the method, the filaments advance after their extrusion and before their solidification through a cooling shaft that connects to ambient air through an air-permeable cylindrical wall. Thus, a delayed cooling of the filaments is realized, so that the yield forces are advantageously influenced and lead to a further relief of the withdrawal tension. This measure is advantageous in two respects, since it permits on the one hand an increased withdrawal tension during the drawing of the filaments, and since on the other hand the delayed cooling substantially reduces a preorientation of the still molten filaments.

This measure can be still further improved by a variant wherein the filaments advance directly after emerging from the spinneret through a heating zone, wherein an amount of heat is supplied to the filaments.

To operate the method with the least possible expenditure for apparatus, the withdrawal tension may be generated directly by the winding speed of a takeup device.

To produce, if possible, a qualitatively superior and uniform yarn, it is desirable to use a variant of the method wherein the withdrawal tension is defined by a feed system. The feed system is arranged upstream of the takeup device, so that fluctuations in the yarn tension due to the winding can advantageously not become effective in the spinning line. It is possible to produce the yarn with a very uniform withdrawal tension.

In accordance with the invention, it becomes possible to produce a highly oriented yarn with substantially similar properties to a fully drawn yarn by influencing the spinning line. In this connection, the spinning apparatus of the present invention has been found especially advantageous for carrying out the method. In accordance with the invention, a constrictor and a diffuser arranged on the outlet side of the constrictor form a cooling device. The constrictor effects a great acceleration of the air entrained by the filaments. In this process, the cooling air stream is accelerated to a maximum speed in the narrowest cross section. Directly after passing the narrowest cross section of the constrictor, the diffuser causes the cooling air to expand. Thus, the flow velocity of the air slows down, thereby assisting the filament movement for a very short time. A longer treatment zone that favors a preorientation is avoided.

A cooling cylinder composed of an air permeable tubular wall may be positioned between the spinneret nozzle and the constrictor. This helps ensure that no air turbulences develop that influence the advance of the filaments as they enter the constrictor.

In the variants of the method, wherein it suffices to reduce or avoid air frictions that slow down the advance of the filaments for producing a highly oriented yarn, it is preferred to construct the spinning apparatus with the diffuser connected to a vacuum generator.

In this connection, it is possible to avoid turbulence at the outlet end of the cooling device during the expansion of the air stream surrounding the filaments, by constructing the spinning apparatus so that the diffuser connects at its outlet end to an air permeable tubular screen cylinder and which is part of a vacuum chamber which is connected to the vacuum generator. Thus, entrained air is uniformly removed over the entire circumference of the filament bundle.

To realize in the production of the yarn a favorable flow profile, it has been found that the constrictor should have in its narrowest cross section a diameter from at least 10 mm to at most 40 mm.

To make available an adequate quantity of air in the spinning line and in particular in the center of the filament bundle for building up the air stream as well as for cooling the filaments, the cooling cylinder may be subdivided in the direction of the advancing yarn into several zones, with each zone having a wall with a different gas permeability. This configuration makes it possible to influence the quantity of air flowing into the cooling shaft irrespective of the filament speed and irrespective of the differential pressure between the cooling shaft and the surroundings. Thus, it is possible to exert a purposeful influence on the properties of the filaments. The quantity of air entering through the wall of the inlet cylinder is in this instance proportionally dependent on the gas permeability or porosity of the wall. Accordingly, in the case of a high permeability to gas, a larger quantity of air per unit time is admitted into the cooling shaft under otherwise constant conditions. Conversely, in the case of a low permeability to air of the wall a proportionately smaller quantity of air enters the spin shaft. The transition of the pas permeability from the one zone to the other is made preferably stepless to avoid greater differential flows. However, a stepped transition of the gas permeability is likewise possible.

In the production of the yarn, it is especially important that each filament in the spinning line be evenly treated until their combination into a yarn. The nozzle bores of the spinneret are preferably arranged in one or more annular lines of bores, with the bores of each line being equally spaced apart. This ensures that the flow generated in the constrictor is uniformly effective on each of the filaments.

In a further development of the spinning apparatus according to the invention, the yarn is withdrawn from the spinneret by means of a feed system. This allows to adjust the withdrawal tension and yarn tension independently of each other when the yarn is wound. Furthermore, it is possible to generate a highly uniform withdrawal tension.

To be able to produce in a spinning plant a plurality of parallel side by side yarns, the feed system preferably comprises two rolls which are partially looped by the advancing yarn, and with at least one of the rolls being driven. In this embodiment, a decrease in the yarn tension may be adjusted by means of the amount of looping by the yarn on the rolls.

To prevent a premature preorientation of the filaments, a heating device may be provided between the nozzle of the spinneret and the cooling cylinder for thermally treating the filaments.

Both the method and the apparatus of the present invention are suitable for producing highly oriented textile yarns of polyester, polyamide, or polypropylene.

BRIEF DESCRIPTION OF THE DRAWINGS

In the following, several embodiments of the method as well as of the apparatus of the present invention are described in more detail with reference to the attached drawings, in which.

DETAILED DESCRIPTION OF THE PREFERRED EMBODIMENTS

Figure 1:
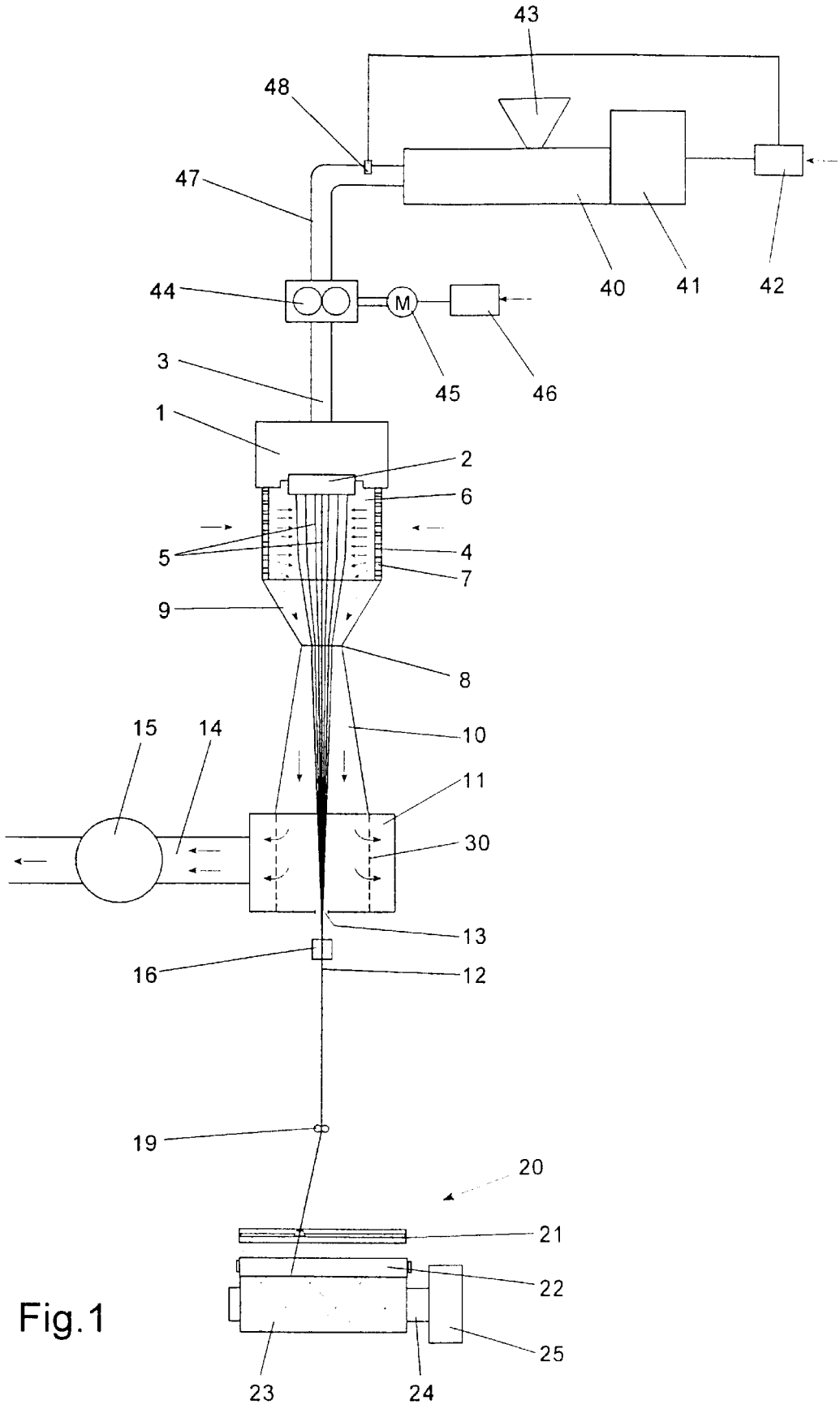
FIG. 1 shows a first embodiment of a spinning apparatus according to the invention.

FIG. 1 shows a first embodiment of a spinning apparatus according to the invention for spinning a highly oriented yarn. In this apparatus, a yarn 12 is spun from a thermoplastic material. To this end, the thermoplastic material is melted via a feed hopper 43 in an extruder 40. The extruder 40 is driven via a drive 41 that connects for its control to a control unit 42. The control may occur, for example, as a function of pressure. To this end, the control unit 42 connects to a pressure sensor 48 arranged at the outlet end of extruder 40. From the extruder 40, the melt advances through a melt line 47 to a distributor pump 44. With respect to its delivery, the pump 44 is controlled by a drive 45 and a controller 46. The distributor pump 44 delivers the melt via a melt line 3 to a heated spin head 1. On its underside, the spin head 1 mounts a spinneret 2. The spinneret 2 comprises on its underside a plurality of nozzle bores. Under pressure, the melt is extruded through the nozzle bores and emerges from the spinneret in the form of fine filament strands 5. The filaments 5 advance through a cooling shaft 6 that is formed by a cooling cylinder 4. To this end, the cooling cylinder 4 extends directly downstream of spinning head 1 and encloses the filaments 5. Subjacent the free end of cooling cylinder 4, in direction of the advancing yarn, is a constrictor 9. In the direction of the advancing yarn, the constrictor 9 narrows the cooling channel 6. In the narrowest cross section of constrictor 9, a diffuser 10 is arranged. A seam 8 interconnects the constrictor 9 and diffuser 10. In direction of the advancing yarn, the diffuser 10 leads to a widening of cooling channel 6. At its end, the diffuser 10 terminates in a vacuum chamber 11. In vacuum chamber 11, a screen cylinder 30 extends in the extension of diffuser 10. The screen cylinder 30 has an air permeable wall and extends through vacuum chamber 11 down to the underside thereof. In the underside of vacuum chamber 11, an outlet opening 13 is arranged in the plane of the advancing yarn. On one side of the vacuum chamber 11, a suction stub 14 terminates therein. Via suction stub 14, a vacuum generator 15 arranged at the free end thereof connects to the vacuum chamber 11. The vacuum generator 15 may be, for example, a vacuum pump or a blower, which generates a vacuum in the vacuum chamber 11 and thus in the diffuser 10.

As seen in FIG. 1, the constriction 9 and the diffuser 10 are each frustoconical, with the angle of cone of the constrictor being greater than the angle of cone of the diffuser.

In the plane of the advancing yarn, downstream of vacuum chamber 11, a lubrication device 16 and a takeup device 20 are arranged. The takeup device 20 comprises a yarn guide 19. This yarn guide 19 indicates the beginning of a traversing triangle that forms by the reciprocal movement of a traversing yarn guide of a yarn traversing device 21. Downstream of yarn traversing device 21 a contact roll 22 is arranged. The contact roll 22 lies against the surface of a package 23 being wound. A rotating winding spindle 24 winds the package 23. To this end, the winding spindle 24 is driven via a spindle motor 25. The drive of winding spindle 24 is controlled as a function of the rotational speed of contact roll 22 such that the circumferential speed of the package remains substantially constant during the winding.

In the spinning apparatus shown in FIG. 1, a polymer melt is delivered to spin head 1 and extruded via spinneret 2 to a plurality of filaments 5. The takeup device 20 withdraws the filament bundle. In so doing, the filament bundle advances at an increasing speed through cooling shaft 6 inside cooling cylinder 4. Subsequently, the filament bundle is sucked into the constrictor 9. The constrictor 9 connects via diffuser 10 to the vacuum generator 15. Thus, due to the vacuum action, ambient air surrounding the outside of cooling cylinder 4 is sucked into the cooling shaft 6. The quantity of air entering the cooling shaft 6 is proportionate to the gas permeability of wall 7 of cooling cylinder 4. The inflowing air leads to a precooling of the filaments, so that the surface layers of the filaments firm up. Due to the narrowest cross section in seam 8, the airflow is accelerated under the action of vacuum generator 15 such that an airflow counteracting the movement of the filaments is reduced or avoided. Thus, the filaments are assisted in their movement, so that during the drawing of the filaments in the solidification region, only a reduced withdrawal tension is effective. The relief of the withdrawal tension is dependent on the extent to which the braking air friction is compensated. In this connection, it is attempted to accelerate the flow velocity, if possible, to the range of the filament speed.

Shortly downstream of seam 8, the filaments are solidified. As they continue to advance in diffuser 10, the filaments are further cooled. To generate as little turbulences as possible in the outlet region of diffuser 10 and, thus, a possibly constant flow profile, the air stream is introduced via the diffuser into the screen cylinder 30 that extends inside vacuum chamber 11 and connects to the vacuum generator 15. The air is then sucked out and removed from vacuum chamber 11 via suction stub 14. The filaments 5 emerge from the underside of vacuum chamber 11 through outlet opening 13, and advance into the lubrication device 16. The lubrication device 13 combines the filaments to a yarn 12. To increase cohesion in the yarn, the yarn could be entangled in an entanglement nozzle before being wound. In the takeup device 20, the yarn 12 is wound to the package 23.

Figure 2:
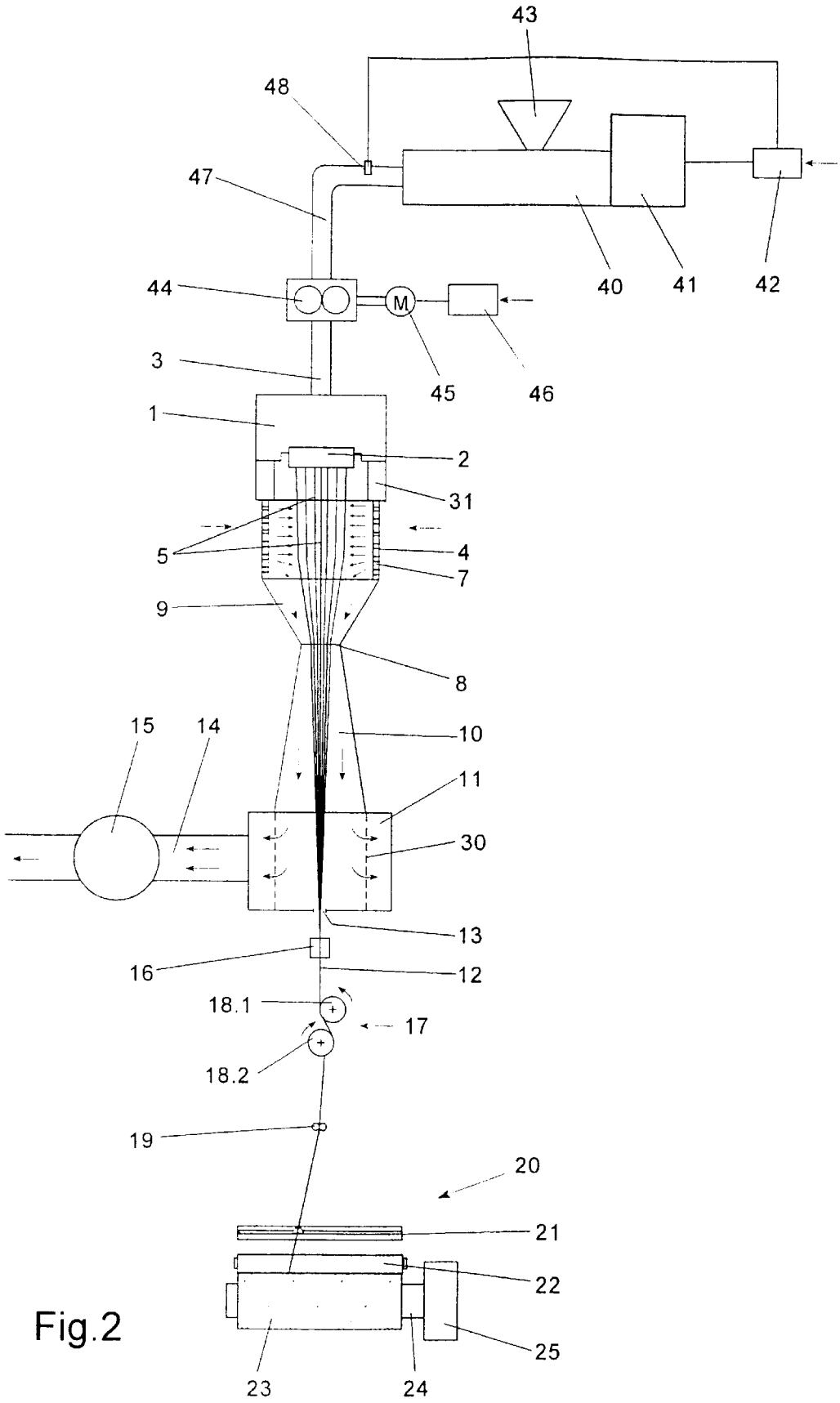
FIG. 2 shows a further embodiment of a spinning apparatus according to the invention.

FIG. 2 shows a further embodiment of a spinning apparatus according to the invention. The basic construction of the spinning apparatus of FIG. 2 is substantially the same as that of FIG. 1. To this extent, the foregoing description of FIG. 1 is herewith incorporated by reference. Only differences in the construction of the spinning apparatus of FIG. 2 are described.

In the spinning apparatus shown in FIG. 2, a heating device 31 directly arranged on spin head 1 extends between spinneret 2 and cooling cylinder 4. The heating device 31 may be, for example, a radiation heater or a cylindrical resistance heater. The additional heating device 31 permits thermal treatment of the filaments after their extrusion through the nozzle bores of spinneret 2, so that a delayed cooling occurs.

Furthermore, the spinning apparatus shown in FIG. 2 comprises a feed system 17 between lubrication device 16 and takeup device 20. The feed system is formed by two driven rolls 18.1 and 18.2. The yarn 12 loops in S-shape about the driven rolls. Thus, the yarn 12 is withdrawn from spinneret 2 by feed system 17 and takeup device 20. The circumferential speed of rolls 18.1 and 18.2 is greater than the winding speed, thereby decreasing the tension in the yarn between the feed system 17 and the takeup device 20. In the present embodiment, the looping angle on the rolls is invariably predetermined. However, it is also possible to make rolls 18.1 and 18.2 adjustable, so that different looping angles can be adjusted. The essential advantage of the additional feed system of the spinning apparatus of FIG. 2 lies in that the fluctuations in the yarn tension resulting from the traversing movement can propagate only to the feed system. The withdrawal tension in the spin zone remains unchanged, which leads to a uniform yarn formation.

Figure 3:
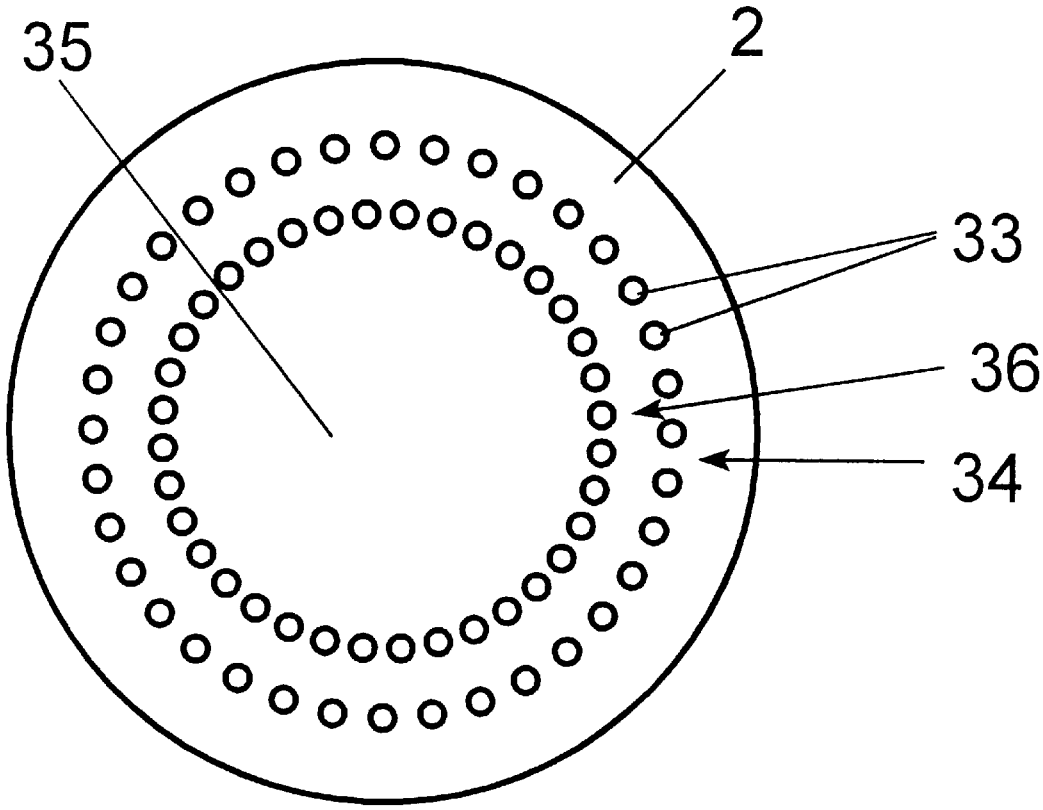
FIG. 3 is a top view of an embodiment of a spinneret.

FIG. 3 is a top view of an embodiment of a spinneret 2, as could be used, for example in the spinning apparatus of FIG. 1 or FIG. 2. In this embodiment of spinneret 2, nozzle bores 33 are annularly arranged in a line of bores 34. In the line of bores 34, the nozzle bores 33 are arranged in spinneret 2 in equally spaced relationship. Further nozzle bores are arranged in a second line of bores 36 concentric with the line of bores 34. The nozzle bores 33 of both lines of bores 34 and 36 are offset from one another, so that the nozzle bores of the inner line of bores 36 come to lie between two adjacent nozzle bores of the outer line of bores 34. This arrangement of bores encloses a center inlet region 35 that has no nozzle bores. With this configuration, it is accomplished that with the use of a frustoconical constrictor and a frustoconical diffuser a flow profile is generated in the narrowest cross section that is effective substantially uniformly on each individual filament. As is known, the flow profile of a circular body traversed by a flow exhibits in its center a maximum flow velocity that decreases toward the peripheral regions. Thus, the annular arrangement of the nozzle bores in spinneret 2 permits advancing the filaments advantageously in zones, wherein the flow velocity generated by the constrictor is uniform.

Figure 4:
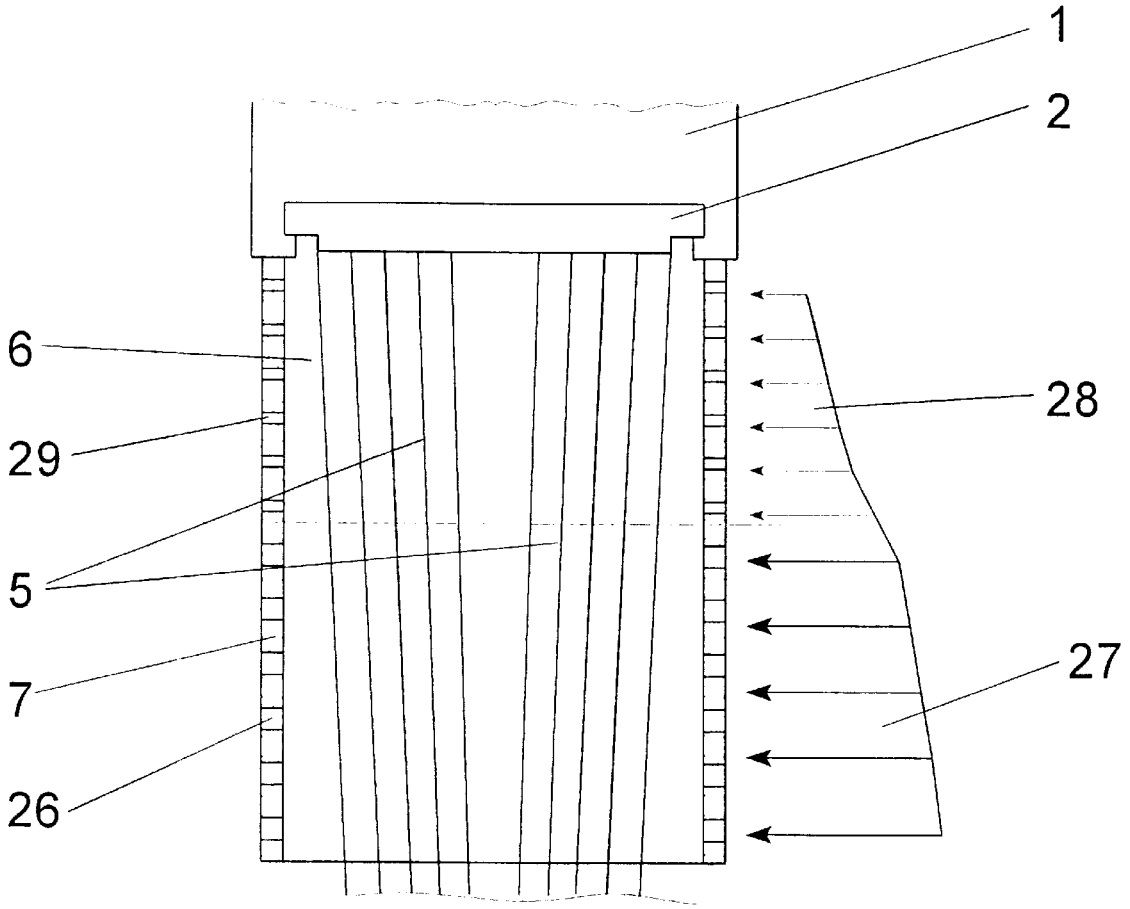
FIG. 4 is a schematic cross sectional view of an embodiment of a cooling cylinder.

FIG. 4 shows an embodiment of a cooling cylinder, such as could be used in the spinning apparatus of FIG. 1 or FIG. 2. The cooling cylinder 4 has a wall 7 constructed of a perforated sheet element with two different perforations 29 and 26. An upper zone at the end of the cooling cylinder, which faces spinneret 2 contains a perforation 29 with a small diameter. The perforation in the upper zone leads to a schematically illustrated inflow profile 28. The inflow profile 28 that is symbolized by arrows, provides a measurement for the air quantity entering the cooling shaft 6. The perforation 29 is identical within the upper zone. Thus, the quantity of air increases as the distance from the spinneret becomes greater due to the vacuum action in constrictor 9 and due to the increasing filament speed.

In a lower zone that is formed at the end facing constrictor 9, the wall 7 contains a perforation 26 with a larger opening cross section. As shown by symbolized inflow profile 27, a larger quantity of air will enter the cooling shaft 6 in the lower zone. Likewise here, one notices the tendency that the quantity of inflowing air increases as the distance from the spinneret becomes greater.

The inflow profile shown in FIG. 4 above the wall of the cooling cylinder is especially suitable for realizing a slow and slight precooling of the filaments. This leads in particular to a very uniform cross section of the yarn. With that, it is possible to adapt the air quantity to the heat treatment of the filaments. It is possible to influence advantageously both precooling and the formation of the cooling stream.

The method of the invention permits production of HOY yarns, which have physical properties that permit direct further processing. Thus, properties are obtained that otherwise are ascribed only to FDY yarns. Typical elongation and tenacity values of FDY yarns are about 30% and >4 cN/dtex. In comparison therewith, Table 1 shows two polyester yarns that were produced by the method of the present invention. In this process, the variant of the method was applied as results from the arrangement of the spinning apparatus of FIG. 2. The withdrawal speed was set to 7,500 m/min. To assist the advance of the filaments, an air stream was generated in the constrictor that reached a velocity of about 2,500 m/min. Despite the high withdrawal speeds, tenacity values were obtained that were clearly higher than 4 cN/dtex. With yarn deniers of 55 dtex and 83 dtex, the elongation was respectively 34% and 30%. Both yarns distinguished themselves by a very good modulus ratio. The boiling shrinkage of 3% to 2.8% was satisfactory.

Figure 5:
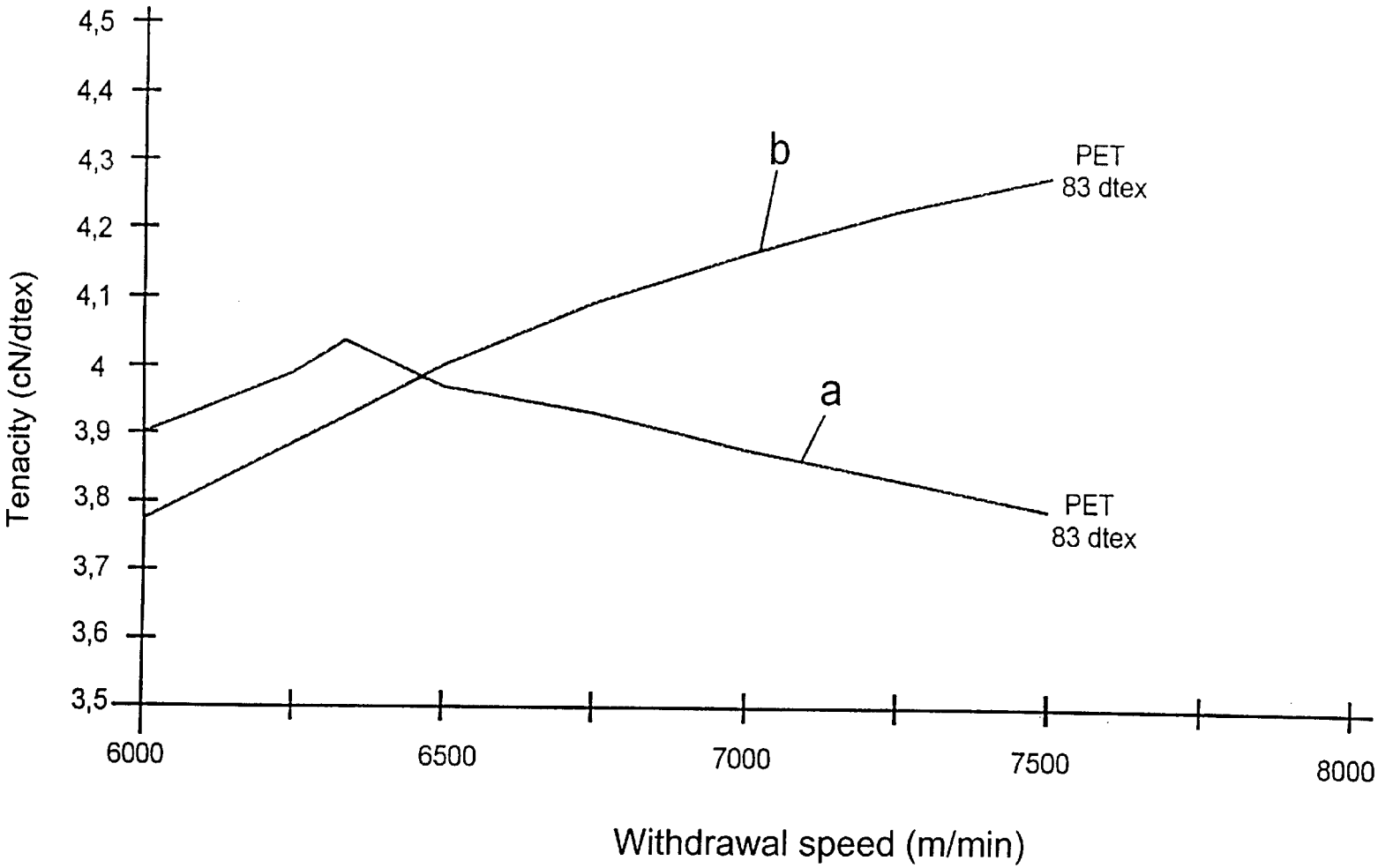
FIG. 5 is a diagram of the tenacity of a yarn as a function of the withdrawal speed.

FIG. 5 illustrates a diagram, wherein the tenacity of a polyester yarn is plotted as a function of the withdrawal speed. Two curves are shown that are indicated by lowercase characters a and b. In both cases, a polyester yarn with a denier of 83 dtex was spun. The tenacity curve identified by a shows the tenacity of a yarn produced by a process known from the state of the art. As shown, tenacity starts to fall shortly before reaching the withdrawal speed of 6,500 m/min and drops as the withdrawal speed increases. The drop in the breaking tenacity shows the overstress of the yarn in this process. The filaments are overstressed in the yield point, since in this point an already too highly crystallized and thus structurally frozen yarn is to be still drawn. Thus, in the method of the prior art, individual filament breaks occur already effective a speed >6,500 m/min.

The tenacity curve identified at b shows the course of the tenacity of a polyester yarn that was produced by the method of the present invention. Despite the high withdrawal speed, one can note a steady increase in tenacity. Thus, the invention makes it possible to produce a highly oriented yarn at greater withdrawal speeds, while maintaining a spinning reliability even at withdrawal speeds >7,500 m/min.

Therefore, by suitable measures, even appreciably higher withdrawal speeds can be realized for producing a highly oriented yarn.

TABLE 1

| Polymer | PET | PET |
|---|---|---|
| Denier (dtex) | 55 | 83 |
| Number of filaments | 24 | 36 |
| Withdrawal speed (m/min) | 7500 | 7500 |
| Air velocity (m/min) at outlet of constrictor | 2500 | 2500 |
| Elongation (%) | 34 | 30 |
| Tenacity (cN/dtex) | 4, 15 | 4, 2 |
| Uster (%) | 1, 4 | 0, 87 |
| Boiling shrinkage (%) | 3 | 2, 8 |

That which is claimed:

1. A method of producing a highly oriented yarn from a thermoplastic material, comprising the steps of extruding a melted thermoplastic material through a nozzle to form a plurality of downwardly advancing filaments, and such that the filaments solidify at a location spaced below the nozzle, withdrawing the filaments under a withdrawal tension so as to cause the filaments to be drawn while being solidified, with the withdrawal tension being generated by a withdrawal speed of at least about 6,500 m/min, and assisting the filaments in their advance before their solidification with help of an airflow while passing the filaments through a constrictor and a diffuser that are interconnected by a seam at the most narrow cross-section such that before their solidification the filaments are relieved from tensile stress and during solidification and drawing a reduced withdrawal tension is effective on the filaments, wherein shortly downstream of the seam the filaments solidify.

2. The method as defined in claim 1 comprising the further steps of combining the filaments after their solidification to form an advancing multifilament yarn, and winding the advancing multifilament yarn into a package.

3. The method as defined in claim 2 wherein the step of assisting the filaments in their advance includes injecting the melted thermoplastic at a high injection speed during the extruding step.

4. The method as defined in claim 2 wherein the step of assisting the filaments in their advance with an airflow includes generating a cooling air stream that flows along with the advancing filaments.

5. The method as defined in claim 4 wherein the cooling air stream has a flow velocity that is substantially the same as the advancing speed of the filaments before their solidification.

6. The method as defined in claim 4 wherein the cooling air stream has a flow velocity that is greater than the advancing speed of the filaments before their solidification.

7. The method as defined in claim 4 wherein the constrictor has its most narrow cross section at an outlet end thereof with the outlet end connecting to the diffuser to which a vacuum is applied for generating the cooling air stream.

8. The method as defined in claim 4 wherein the assisting step includes guiding the advancing filaments before their solidification through a cooling shaft that connects to the ambient air through an air permeable cylindrical wall, so that the ambient air forms the cooling air stream.

9. The method as defined in claim 4 comprising the further step of guiding the advancing filaments through a heating zone located immediately below the extrusion nozzle so as to heat the advancing filaments.

10. The method as defined in claim 2 wherein the withdrawal tension is generated by the winding step, such that the withdrawal speed is determined by the winding speed.

11. The method as defined in claim 2 wherein the withdrawal tension is generated by a feed system arranged in the path of the advancing multifilament yarn upstream of the winding step, and with the withdrawal speed of the feed system being greater than the winding speed of the winding step.

12. The method as defined in claim 11 wherein the feed system comprises two rolls that are looped by the advancing yarn in S-shape or Z-shape.

13. A melt spinning apparatus for producing a highly oriented yarn from a thermoplastic melt, comprising an extruder for heating a thermoplastic material and extruding the resulting melt through a nozzle having a plurality of nozzle bores to form a plurality of downwardly advancing filaments, a cooling chamber disposed below the nozzle, a lubrication device for combining the downwardly advancing filaments to form an advancing multifilament yarn, and a yarn winding device for winding the advancing yarn into a package, said cooling chamber comprising a constrictor through which the filaments advance, and a diffuser arranged at the outlet end of the constrictor, with the constrictor and the diffuser each having a flow cross section that varies in the direction of the advancing filaments so that the most narrow cross section is present in a connecting seam between the constrictor and the diffuser shortly upstream of the solidification point of the filaments.

14. The apparatus as defined in claim 13 further comprising a cooling cylinder positioned between the nozzle and the constrictor, said cooling cylinder comprising an air permeable tubular wall which encloses the downwardly advancing filaments.

15. The apparatus as defined in claim 14 wherein the diffuser is connected to a vacuum generator.

16. The apparatus as defined in claim 15 wherein the diffuser is connected at its outlet end to an air permeable tubular screen cylinder which surrounds the advancing filaments so as to define a vacuum chamber which forms a connection between the vacuum generator and the diffuser.

17. The apparatus as defined in claim 13 wherein the constrictor and the diffuser are each frustoconical, with the angle of cone of the constrictor being greater than the angle of cone of the diffuser.

18. The apparatus as defined in claim 14 wherein the cooling cylinder is subdivided in the direction of the advancing yarn into several zones, with each zone having a different gas permeability.

19. The apparatus as defined in claim 13 wherein the nozzle bores are arranged in one or more annular lines of bores, with the bores of each line of bores being equally spaced from one another.

20. A method of producing a highly oriented yarn from a thermoplastic material, comprising the steps of extruding a melted thermoplastic material through a nozzle to form a plurality of downwardly advancing filaments, and such that the filaments solidify at a location spaced below the nozzle, withdrawing the filaments under a withdrawal tension so as to cause the filaments to be drawn while being solidified, with the withdrawal tension being generated by a withdrawal speed of at least about 6,500 m/min, assisting the filaments in their advance before their solidification such that before their solidification the filaments are relieved from tensile stress and during solidification and drawing a reduced withdrawal tension is effective on the filaments, combining the filaments after their solidification to form an advancing multifilament yarn, winding the advancing multifilament yarn into a package, and wherein the step of assisting the filaments in their advance includes injecting the melted thermoplastic at a high injection speed during the extruding step.

21. A method of producing a highly oriented yarn from a thermoplastic material, comprising the steps of extruding a melted thermoplastic material through a nozzle to form a plurality of downwardly advancing filaments, and such that the filaments solidify at a location spaced below the nozzle, withdrawing the filaments under a withdrawal tension so as to cause the filaments to be drawn while being solidified, with the withdrawal tension being generated by a withdrawal speed of at least about 6,500 m/min, assisting the filaments in their advance before their solidification such that before their solidification the filaments are relieved from tensile stress and during solidification and drawing a reduced withdrawal tension is effective on the filaments, combining the filaments after their solidification to form an advancing multifilament yarn, winding the advancing multifilament yarn into a package, and wherein the withdrawal tension is generated by a feed system arranged in the path of the advancing multifilament yarn upstream of the winding step, and with the withdrawal speed of the feed system being greater than the winding speed of the winding step.

22. The method as defined in claim 21 wherein the feed system comprises two rolls that are looped by the advancing yarn in S-shape or Z-shape.

23. A melt spinning apparatus for producing a highly oriented yarn from a thermoplastic melt, comprising an extruder for heating a thermoplastic material and extruding the resulting melt through a nozzle having a plurality of nozzle bores to form a plurality of downwardly advancing filaments, a cooling chamber disposed below the nozzle, a lubrication device for combining the downwardly advancing filaments to form an advancing multifilament yarn, a yarn winding device for winding the advancing yarn into a package, said cooling chamber comprising a constrictor through which the filaments advance, and a diffuser arranged at the outlet end of the constrictor, with the constrictor and the diffuser each having a flow cross section that varies in the direction of the advancing filaments so that the most narrow cross section is present in a connecting seam between the constrictor and the diffuser, and wherein the constrictor has in its most narrow cross section a diameter between about 10 mm and 40 mm.

24. A melt spinning apparatus for producing a highly oriented yarn from a thermoplastic melt, comprising an extruder for heating a thermoplastic material and extruding the resulting melt through a nozzle having a plurality of nozzle bores to form a plurality of downwardly advancing filaments, a cooling chamber disposed below the nozzle, a lubrication device for combining the downwardly advancing filaments to form an advancing multifilament yarn, a yarn winding device for winding the advancing yarn into a package, said cooling chamber comprising a constrictor through which the filaments advance, and a diffuser arranged at the outlet end of the constrictor, with the constrictor and the diffuser each having a flow cross section that varies in the direction of the advancing filaments so that the most narrow cross section is present in a connecting seam between the constrictor and the diffuser, and a feed system arranged in the yarn path between the diffuser and the yarn winding device.

25. The apparatus as defined in claim 24 wherein the feed system comprises two rolls with at least one of the rolls being driven, and wherein the rolls are arranged relative to each other in the yarn path such that they are partially looped by the advancing yarn.

* * * * *